US010067466B2

(12) United States Patent
Fukase et al.

(10) Patent No.: US 10,067,466 B2
(45) Date of Patent: Sep. 4, 2018

(54) IMAGE FORMING APPARATUS

(71) Applicant: CANON KABUSHIKI KAISHA, Tokyo (JP)

(72) Inventors: Yasuhiro Fukase, Kawasaki (JP); Takeo Kawanami, Kamakura (JP); Tetsuo Furukawa, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/583,535

(22) Filed: May 1, 2017

(65) Prior Publication Data

US 2017/0235276 A1 Aug. 17, 2017

Related U.S. Application Data

(63) Continuation of application No. 14/909,326, filed on Nov. 26, 2013, now abandoned.

(30) Foreign Application Priority Data

Nov. 29, 2012 (JP) ..... 2012-261448
Nov. 29, 2012 (JP) ..... 2012-261454

(51) Int. Cl.
*G03G 21/18* (2006.01)

(52) U.S. Cl.
CPC ..... *G03G 21/1842* (2013.01); *G03G 21/1814* (2013.01)

(58) Field of Classification Search
None
See application file for complete search history.

(56) References Cited

U.S. PATENT DOCUMENTS

2010/0209139 A1* 8/2010 Sakurai ..... G03G 21/1853 399/111
2011/0200355 A1* 8/2011 Mori ..... G03G 15/1685 399/110
2012/0114398 A1* 5/2012 Lee ..... G03G 15/0189 399/308

* cited by examiner

*Primary Examiner* — Thomas Giampaolo, II
(74) *Attorney, Agent, or Firm* — Canon U.S.A., Inc. IP Division

(57) ABSTRACT

An image forming apparatus including: a plurality of cartridges; a belt configured to abut against the photosensitive drums of the plurality of cartridges; a frame configured to axially support a plurality of rollers around which the belt is extended; and a movable member configured to be movable while supporting the plurality of cartridges, the movable member being movable between a first position in which the plurality of cartridges are in an main body of the apparatus and a second position in which the plurality of cartridges are drawn out from the main body of the apparatus, wherein the frame is provided with a plurality of positioning portions configured to allow abutment of the plurality of cartridges and determine the positions of the plurality of cartridges in the main body of the apparatus.

14 Claims, 13 Drawing Sheets

IMAGE FORMING APPARATUS

This application is a Continuation of U.S. patent application Ser. No. 14/090,326 filed Nov. 26, 2013, which claims the benefit of Japanese Patent Application No. 2012-261454 filed Nov. 29, 2012 and Japanese Patent Application No. 2012-261448 filed Nov. 29, 2012. U.S. patent application Ser. No. 14/090,326, Japanese Patent Application No. 2012-261454, and Japanese Patent Application No. 2012-261448 are hereby incorporated by reference herein in their entirety.

BACKGROUND OF THE INVENTION

Field of the Invention

This disclosure relates to an image forming apparatus of an electrophotographic system such as laser beam printers or copying machines.

Description of the Related Art

In an image forming apparatus of an electrophotographic system, a cartridge having a photosensitive member and a cartridge in which toner is stored are demountably mounted on a main body of an apparatus in order to facilitate replacement of the photosensitive member and a supply of toner.

A configuration in which a positioning member configured to determine the position of the cartridge in the main body of the apparatus by abutment of the cartridge at both ends in the direction of a photosensitive drum is provided in a frame of the main body of the apparatus is disclosed in Japanese Patent Laid-Open No. 2009-128506.

However, with the configuration disclosed in Japanese Patent Laid-Open No. 2009-128506, since a specific positioning member configured to fix the position of the cartridge is provided, securement of a space for arranging a specific positioning member is required in the interior of the main body of the apparatus. Therefore, the size of the apparatus may be increased by an amount corresponding to the space. In addition, the specific positioning member may increase cost correspondingly or a process of mounting the specific positioning member may be increased at the time of manufacture.

SUMMARY OF THE INVENTION

This disclosure suppresses increase in size of an apparatus, and suppresses increase in number of processes for mounting a specific positioning member configured to fix the position of a cartridge.

This disclosure also provides an image forming apparatus described below.

An image forming apparatus including:

a plurality of cartridges each include a photosensitive member;

a belt configured to abut against the photosensitive drums of the plurality of cartridges;

a frame configured to axially support a plurality of rollers around which the belt is extended; and a movable member configured to be movable while supporting the plurality of cartridges, the movable member being movable between a first position in which the plurality of cartridges are within an main body of the apparatus and a second position in which the plurality of cartridges are drawn out from the main body of the apparatus, wherein the frame is provided with a plurality of positioning portions configured to allow abutment of the plurality of cartridges and determine the positions of the plurality of cartridges in the main body of the apparatus.

Further features of the present invention will become apparent from the following description of exemplary embodiments with reference to the attached drawings.

DESCRIPTION OF THE EMBODIMENTS

First Embodiment

Embodiments of this disclosure will be described. In the following description, in a case of including a plurality of apparatuses having the same configuration such as photosensitive drums 1*a*, 1*b*, 1*c*, and 1*d*, the configuration and the operation will be described by expressing such a plurality of components collectively as photosensitive drum 1 for simplification.

General Configuration of Apparatus

Figure 8:
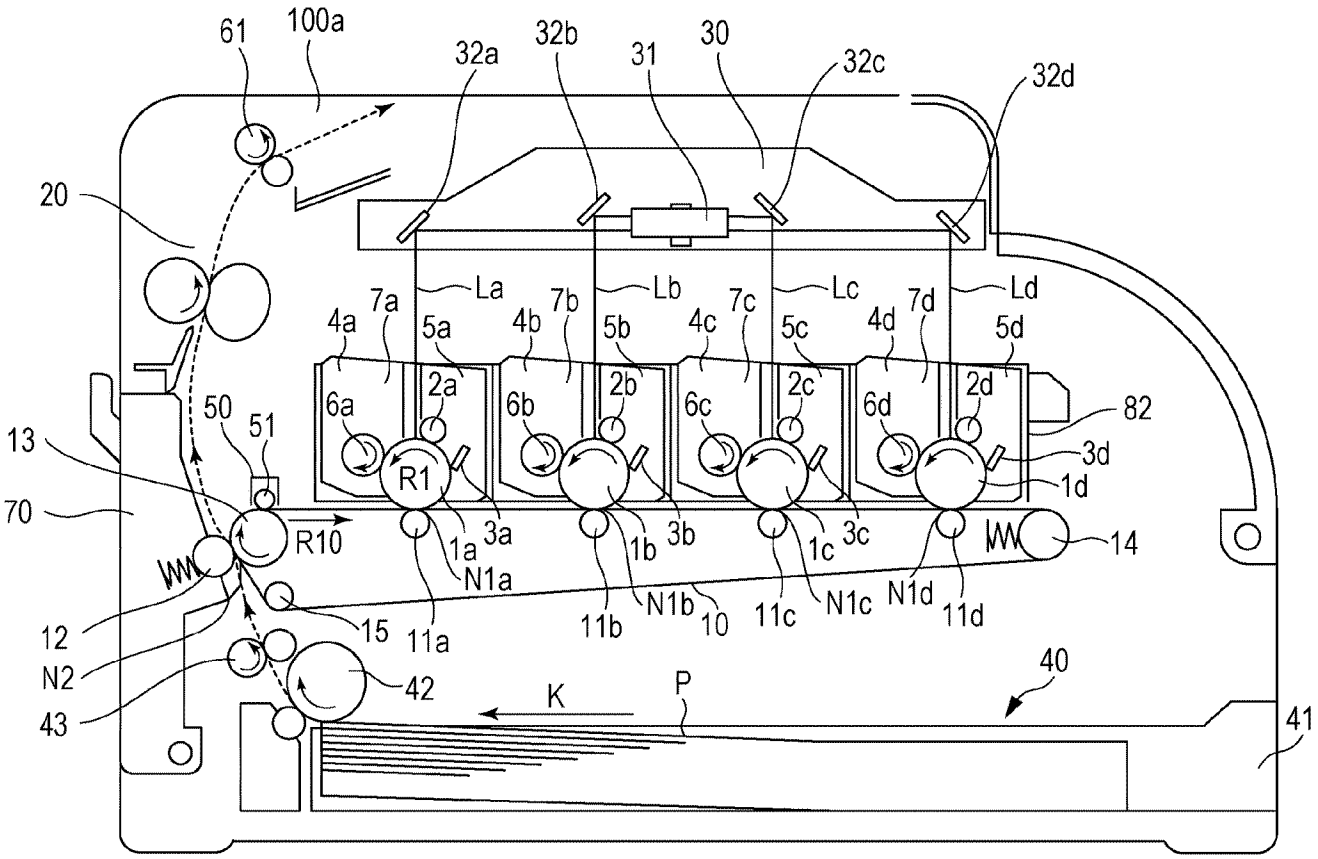
FIG. 8 is a schematic cross-sectional view of the image forming apparatus.

FIG. 8 is a schematic cross-sectional view of an image forming apparatus 100. The image forming apparatus 100 is a tandem type laser beam printer of an electrophotographic system including an intermediate transfer member 10, and is capable of forming color images in four colors onto sheet-type recording material such as paper sheets or OHP sheets.

A configuration of the image forming apparatus 100 will be described below. The image forming apparatus 100 includes drum-shaped electrophotographic photosensitive members (hereinafter, referred to as "photosensitive drums") 1 (1*a* to 1*d*) for each color. The photosensitive drum 1 is rotatably supported by the image forming apparatus 100, and are driven to rotate in a direction indicated by an arrow R1 by a drive unit (not illustrated). The following members are arranged in the peripheries of the photosensitive drum 1 along a direction of rotation thereof. A charging roller 2 (2*a* to 2*d*) configured to charge the photosensitive drum 1, an exposure unit 30 configured to irradiate the photosensitive drum 1 with a laser beam L (La to Ld) on the basis of image information, developing unit 4 having a developing roller 6 (6*a* to 6*d*), the intermediate transfer belt (intermediate transfer member) 10 to which a toner image is primarily transferred from the photosensitive drum 1, and a cleaner unit 5 (5*a* to 5*d*) provided with a cleaning blade 3 (3*a* to 3*d*) configured to remove toner on surfaces of the photosensitive drum 1 and arranged. The photosensitive drum 1 and the charging roller 2 are axially supported respectively by the cleaner unit 5. The cleaner unit 5 and the corresponding developing unit 4 constitute a cartridge 7 (7*a* to 7*d*), which corresponds to a unit which is integrally mountable and demountable with respect to the main body of the apparatus 100*a*. The cartridge 7 is demountably mountable to the main body of the apparatus 100*a* independently. The cartridges 7*a* to 7*d* contain toners in different colors (yellow, magenta, cyan, and black) respectively in the corresponding developing units 4*a* to 4*d*. In this manner, the cartridge 7 integrally includes the charging roller 2, the developing roller 6, and the cleaning blade 3, which correspond to process devices acting on the photosensitive drum 1.

The photosensitive drum 1 is formed of an aluminum cylinder provided with a photoconductive layer such as OPC (organic optical semiconductor) on an outer peripheral surface thereof. The charging roller 2 is formed of a core metal and a conductive resilient member surrounding a periphery of the core metal, are arranged in contact with the surface of the photosensitive drum 1 so as to be driven to rotate, and is applied with a charging bias by a power source (not illustrated). The exposure unit 30 includes a laser light source (not illustrated) configured to emit the laser beams La to Ld, a polygon mirror 31 configured to reflect the laser beams emitted from the laser light source, mirrors 32, and a lens (not illustrated), which the laser beams pass through. The exposure unit 30 is configured to irradiate the charged photosensitive drum 1 with the laser beam on the basis of the image information and form an electrostatic latent image. The developing unit 4 includes the developing roller 6 arranged at a developing position which comes into abutment with the surface of the photosensitive drum 1 so as to develop the electrostatic latent image by causing toner to be adhered to the electrostatic latent image on the surface of the photosensitive drum 1. Then, the developing unit 4 develops the photosensitive drum 1 to form the toner image on the respective surface of the photosensitive drum 1.

The intermediate transfer belt 10 is a belt formed into an endless belt so as to form a loop, and is extended around a drive roller 13, a tension roller 14, and an auxiliary roller 15, which correspond to three extension rollers arranged in parallel to each other. By the drive roller 13 rotated by the drive unit (not illustrated), the intermediate transfer belt 10 is driven (travelled) so that a surface thereof moves in a direction indicated by an arrow R10. At this time, the tension roller 14 and the auxiliary roller are driven by the intermediate transfer belt 10 to rotate.

Inside the loop of the intermediate transfer belt 10, primary transfer roller 11 (11*a* to 11*d*) is arranged to press the intermediate transfer belt 10 against the surface of the photosensitive drum 1 and form primary transfer nip portion N1 (N1*a* to N1*d*) between the photosensitive drum 1 and the intermediate transfer belt 10. A primary transfer bias is applied to the primary transfer roller 11 by the power source (not illustrated). Also, a secondary transfer roller 12 is arranged on an outer peripheral surface of the intermediate transfer belt 10 at a position opposing the drive roller 13 and forms a secondary transfer nip portion N2 with the intermediate transfer belt 10 therebetween. A secondary transfer bias is applied to the secondary transfer roller 12 by the power source (not illustrated).

Furthermore, a belt cleaner 50 having a roller charger 51 opposing the outer peripheral surface of the intermediate transfer belt 10 is provided on a downstream side of the secondary transfer nip portion N2 and an upstream side of the primary transfer nip portion N1*a* with respect to the direction of movement of the surface of the intermediate transfer belt 10.

A sheet supplying unit 40 is configured to feed a recording material P to the secondary transfer nip portion N2 and includes a sheet supplying cassette 41 in which a plurality of the recording materials P are stored, a supply roller 42, and a registration roller 43.

A fixing device 20 configured to heat and pressurize the recording material P to fix the toner on the recording material P is provided on the downstream side of the secondary transfer nip portion N2 with respect to the direction of conveyance of the recording material P (a direction indicated by an arrow K).

Image Forming Operation

Subsequently, an image forming operation of the image forming apparatus 100 will be described. The photosensitive drum 1 is formed with a toner image on the surface thereof while being driven to rotate in the direction indicated by the arrow R1 through the following process. First of all, the surface of the photosensitive drum 1 comes into abutment with the charging roller 2 to which a charging bias is applied is charged to a predetermined potential. Subsequently, the exposure unit 30 irradiates the surface with the laser beam L on the basis of image information, so that an electrostatic latent image is formed on the surface. Toner is adhered to part of the electrostatic latent image on the surface of the photosensitive drum irradiated with the laser beam at a position opposing the developing roller 6 (a position in abutment with each other), whereby a toner image formed by developing the electrostatic latent image appears. By performing the operation as described above for the photosensitive drums 1*a* to 1*d*, toner images having different colors (yellow, magenta, cyan, and black) are formed on the photosensitive drums 1*a* to 1*d* respectively.

Then, the toner images on the photosensitive drums 1*a* to 1*d* at the primary transfer nip portions N1*a* to N1*d* are transferred to the intermediate transfer belt 10 by the action of the primary transfer biases applied on the primary transfer rollers 11*a* to 11*d*. The toner images on the photosensitive drums 1*a* to 1*d* are formed at timings which cause all the toner images to be superimposed one on top of another when transferred to the intermediate transfer belt 10. Therefore, a toner image in four colors formed by the superimposed toner images in yellow, magenta, cyan, and black is formed on the intermediate transfer belt 10. The toner remaining on the photosensitive drum 1 after passage through the primary transfer nip portions N1 is scraped off by the cleaning blade 3 of the cleaner unit 5.

The toner image on the intermediate transfer belt 10 is conveyed to the secondary transfer nip portion N2 by the rotation of the intermediate transfer belt 10. The toner image on the intermediate transfer belt 10 is transferred with precise timing at the secondary transfer nip portion N2 onto the recording material P conveyed to the secondary transfer nip portion N2 by an operation of the secondary transfer bias applied to the secondary transfer roller 12.

The recording material P, to which the toner image is transferred, is conveyed to the fixing device 20, and heated and pressurized, whereby the toner image is fixed (fused and fixed) to the recording material P. Accordingly, a color image in four colors is formed on the recording material P. The recording material P passed through the fixing device 20 in this manner is discharged out of the main body of the apparatus 100*a* by a discharging roller 61.

The toner remaining on the surface of the intermediate transfer belt 10 after the passage through the secondary transfer nip portion N2 is inverted in polarity by the roller charger 51 of the belt cleaner 50, is transferred to the photosensitive drum 1 at the primary transfer nip portions N1 and is scraped off by the cleaner unit 5.

Configuration of Frame Body in Apparatus

Figure 3:
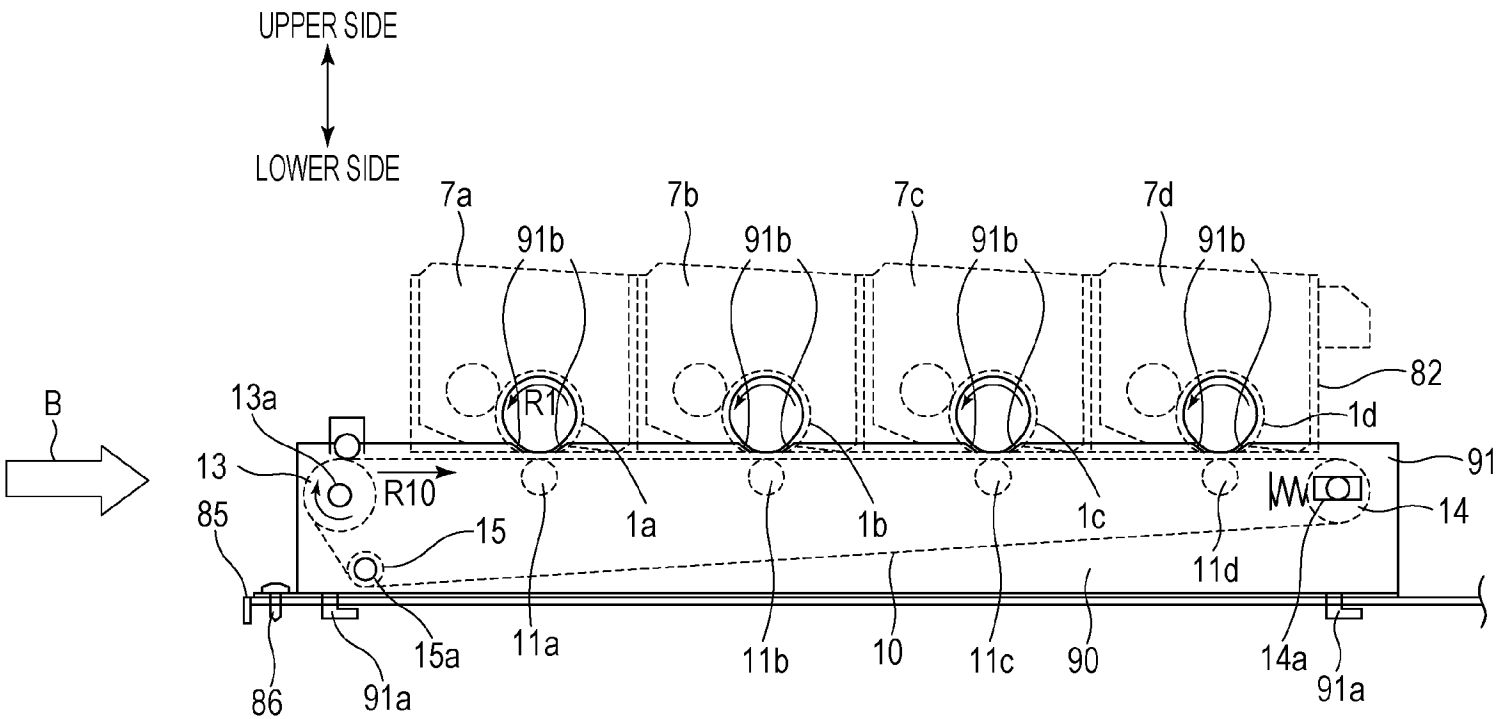
FIG. 3 is a schematic cross-sectional view of a portion around the cartridges and an intermediate transfer belt of the image forming apparatus viewed from a direction of axes of photosensitive drums.
Figure 4:
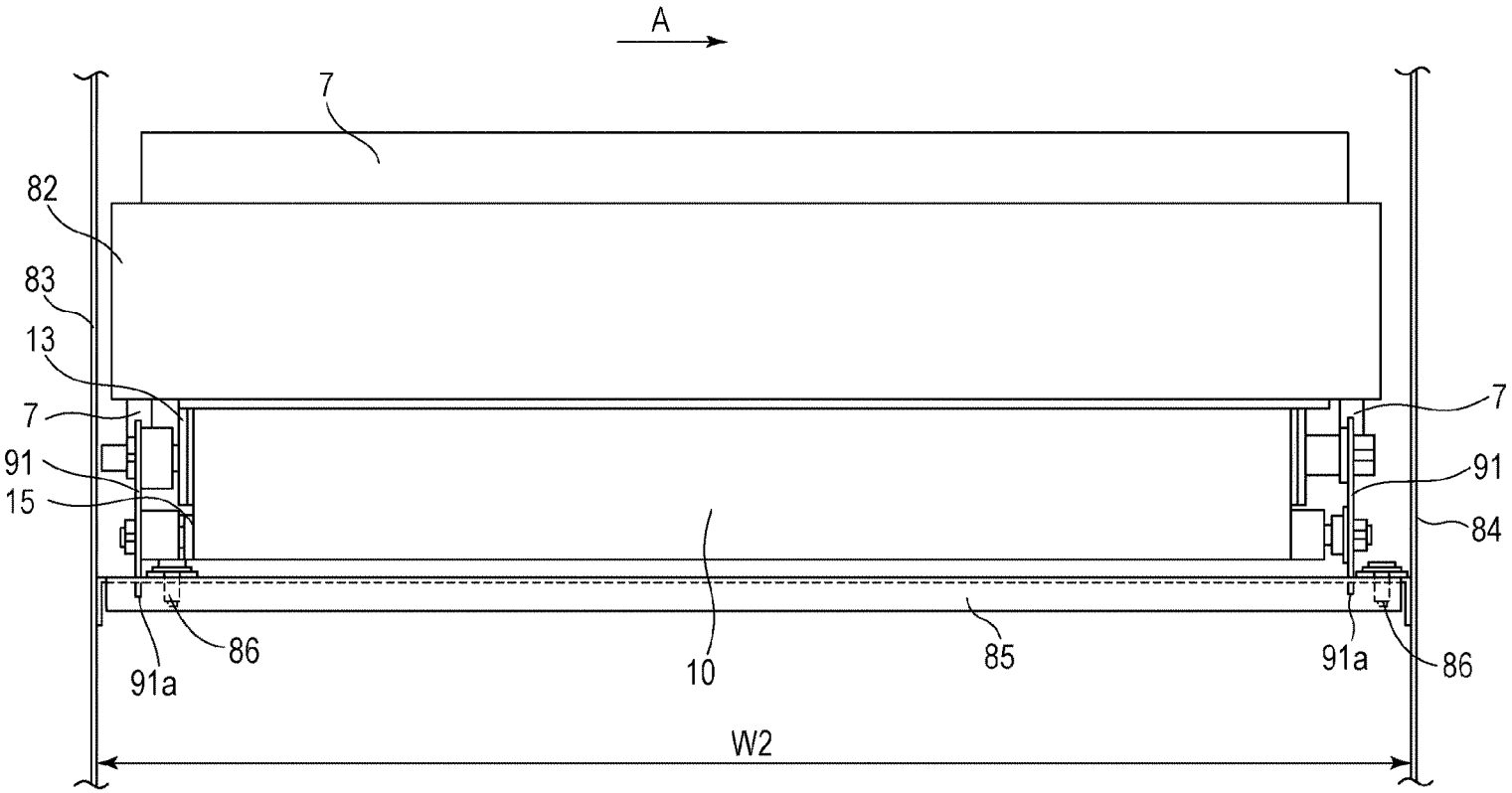
FIG. 4 is a drawing of the portion around the cartridges and the intermediate transfer belt of the image forming apparatus viewed from a direction of an array of the photosensitive drums.
Figure 5:
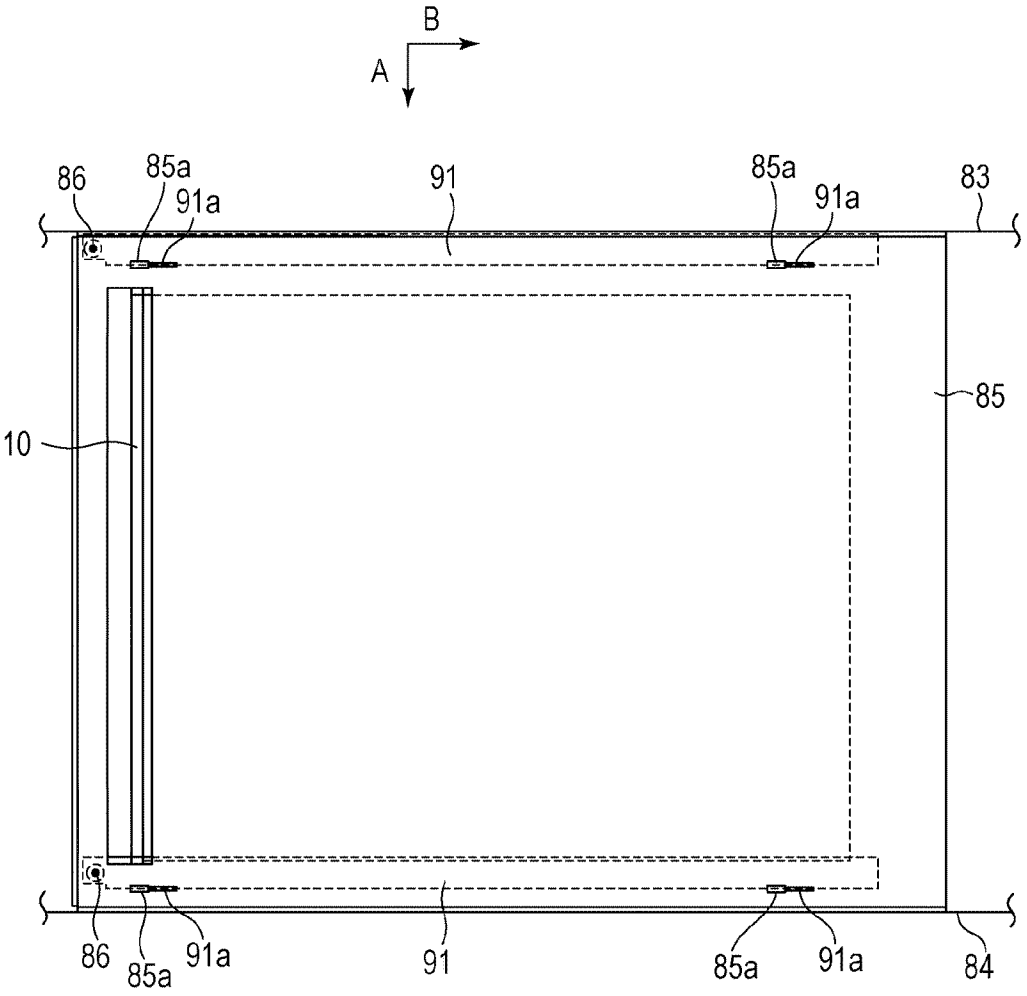
FIG. 5 is a drawing of the portion around the cartridges and the intermediate transfer belt of the image forming apparatus viewed from a direction orthogonal to the direction of the axes of the photosensitive drums and the direction of the array of the photosensitive drums.

Referring subsequently to FIGS. 3 to 6, a configuration of a frame body in the apparatus will be described. FIG. 3 is a schematic cross-sectional view of a portion around the cartridges 7*a* to 7*d* and the intermediate transfer belt 10 of the image forming apparatus viewed from the direction of the axis of the photosensitive drum 1. FIG. 4 is a drawing of the portion around the cartridge 7 and the intermediate transfer belt 10 of the image forming apparatus viewed from a direction of an array of the photosensitive drums 1*a* to 1*d* (direction B). FIG. 5 is a drawing of the portion around the cartridges and the intermediate transfer belt 10 of the image forming apparatus viewed in a direction (lower side) orthogonal to a direction of axes (direction A) and the direction of the array (direction B) of the photosensitive drums 1*a* to 1*d*.

As illustrated in FIG. 4, the main body of the apparatus 100*a* includes a right side plate (main body side plate) 83, a left side plate (main body side plate) 84, and a stay 85 fixed between the right side plate 83 and the left side plate 84 as a frame body. The right side plate 83 and the left side plate 84 are arranged so as to oppose each other with the cartridges 7*a* to 7*d* within the image forming apparatus 100 and the intermediate transfer belt 10 interposed therebetween in the direction of the axis of the photosensitive drum 1 (direction A). A cartridge tray 82, which corresponds to a movable member movable in a state of supporting the cartridges 7*a* to 7*d*, is provided so as to be movable in the direction of the array of the photosensitive drums 1*a* to 1*d* (direction B in FIG. 3) between the right side plate 83 and the left side plate 84. As described in detail later, when replacing the cartridges 7*a* to 7*d*, the cartridge tray 82 supports and moves the cartridges 7*a* to 7*d* to the outside of the main body of the apparatus 100*a*.

Belt Unit

Subsequently, a belt unit 90 provided with the intermediate transfer belt 10 will be described. The belt unit 90 includes a pair of belt unit side plates (frame side plates) 91 provided as a frame of the belt unit 90 at both ends of the intermediate transfer belt 10 with respect to the direction of the axis of the photosensitive drum 1 (direction A). The two belt unit side plates 91 each include bearing portion 13*a*, 14*a*, and 15*a* configured to support bearing members, not illustrated, respectively of the drive roller 13, the tension roller 14, and the auxiliary roller 15, and rotatably support the drive roller 13, the tension roller 14, and the auxiliary roller 15. The two belt unit side plates 91 axially support the primary transfer rollers 11*a* to 11*d* via bearings, not illustrated. The axes of rotation of the drive roller 13, the tension roller 14, and the auxiliary roller 15 are parallel to the direction of the axis of the photosensitive drum 1 (direction A).

The two belt unit side plates 91 are metallic members molded by using the same metal mold and hence have the same shape.

Although detailed description will be given later, the belt unit 90 is demountably mountable with respect to the main body of the apparatus 100*a*, and the belt unit 90 may be mounted on the main body of the apparatus 100*a* by inserting the belt unit 90 from the back side of the main body of the apparatus 100*a* in the direction B. The two belt unit side plates 91 are each provided with protruded portions 91*a*, and these protruded portions 91*a* are inserted into four positioning holes 85*a* (see FIG. 5) formed in the stay 85 and are brought into abutment with edge portions of the positioning holes 85*a* in the direction B, so that the position of the belt unit 90 in the direction B is determined. The positions in other directions are also determined by bringing the belt unit 90 into abutment against positioning portions, not illustrated. Then, the belt unit side plates 91 and the stay 85 are fastened by screws 86, so that the belt unit 90 is fixed onto the stay 85.

Here, when rotating the photosensitive drums 1*a* to 1*d* for performing the image forming operation, the intermediate transfer belt 10 receives a force in a direction R10 by friction or adsorption with respect to the photosensitive drums 1*a* to 1*d* at the primary transfer nip portions N1*a* to N1*d*. However, since the direction of abutment of the belt unit 90 against the stay 85 corresponds to the direction B which is substantially parallel to the direction R10, the position of the belt unit 90 can be maintained with high degree of accuracy even though the belt unit 90 receives a force in the direction R10 as described above. The force in the direction R10 that the belt unit 90 receives from the photosensitive drums 1*a* to 1*d* is transmitted from the edge portion of the positioning holes 85*a* having a relatively high strength to the stay 85. Therefore, in comparison with the configuration in which the forces in the direction R10 which the belt unit 90 receives from the photosensitive drums 1*a* to 1*d* are transmitted to the stay 85 via the screws or the like for fixing the belt unit 90 to the stay 85, a force for fixing the belt unit 90 to the stay 85 (fastening forces of the screws 86, in this case) may be weakened.

Positioning Configuration of Cartridge

Subsequently, a positioning configuration of the cartridge 7, which is the most characteristic configuration of the first embodiment, will be described. The belt unit side plates 91 are each provided with positioning portions 91*b*, each of which is a groove having a V-shape against which the cartridges 7*a* to 7*d* abut in the downward direction (a direction intersecting the direction of array (direction B)). The positions of the cartridges 7*a* to 7*d* are determined in the vertical direction and the fore-and-aft direction (the direction of the array of the cartridges 7*a* to 7*d*) by an abutment of the bearing portions of the photosensitive drums 1*a* to 1*d* provided on the frame bodies of the cartridges 7*a* to 7*d* against the positioning portions 91*b*.

Figure 6:
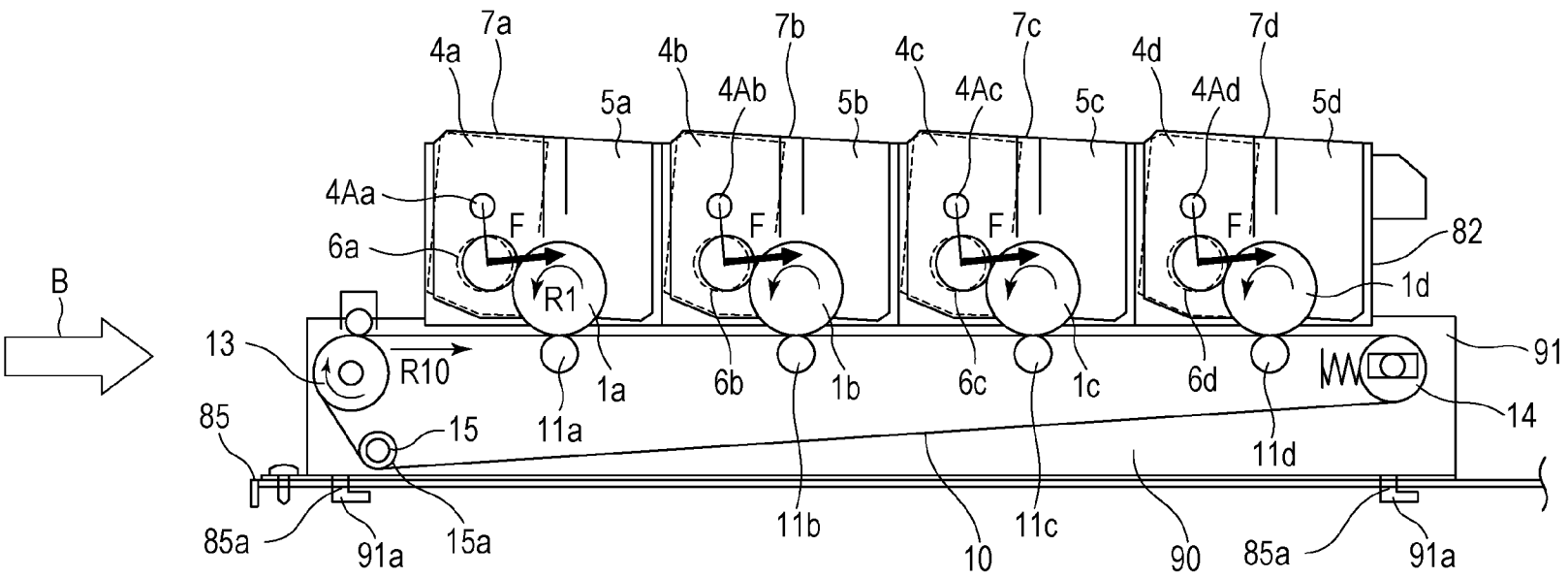
FIG. 6 is a schematic cross-sectional view of the portion around the cartridges and the intermediate transfer belt of the image forming apparatus viewed from the direction of the axes of the photosensitive drums.

The configuration in the first embodiment is that the position of the cartridge 7 is determined by the belt unit 90 as described above. Therefore, an impact occurring when the developing roller 6 abuts against the photosensitive drum 1 is transmitted to the belt unit 90 as well. This phenomenon will be described below. FIG. 6 is a schematic cross-sectional view of the portion around the cartridges and the intermediate transfer belt 10 of the image forming apparatus viewed from the direction of the axis of the photosensitive drum 1. When developing the latent image on the photosensitive drum 1, the developing roller 6 is at developing position where the developing roller 6 abuts against the photosensitive drum 1. Here, in order to prevent scarring or deformation of the photosensitive drum 1 and the developing roller 6 due to a continuous abutment of the developing roller 6 against the photosensitive drum 1, the developing roller 6 is held at a retracted position retracted away from the photosensitive drum 1 during a period other than the period of development of the latent image on the photosensitive drum 1. The developing roller 6 is configured to be movable between the developing position and the retracted positions by rotating about supporting point of rotation 4A (4Aa to 4Ad). In contrast, therefore, when developing the latent image on the photosensitive drum 1, the developing roller 6 is moved from the retracted position to the developing position by being rotated about the supporting point of rotation 4A.

At this time, an impact forces F occurring when the developing roller 6 abuts against the photosensitive drum 1 is transmitted from the photosensitive drum 1 to the belt unit side plates 91 of the belt unit 90 via the frame body of the cartridge 7. However, the direction of the impact force F occurring when the developing roller 6 abuts against the photosensitive drum 1 is substantially parallel to the direction in which the belt unit 90 is brought into abutment with the stay 85 (direction B), and hence the impact force F includes a component in the direction B. Therefore, the position of the belt unit 90 can be maintained with high degree of accuracy even though the belt unit 90 receives a force in a direction F as described above. In the same manner, the forces in the direction F that the belt unit 90 receives from the cartridges 7*a* to 7*d* are transmitted from the edge portions of the positioning holes 85*a* having a relatively high strength to the stay 85. Therefore, in comparison with the configuration in which the forces in the direction F which the belt unit 90 receives from the cartridges 7*a* to 7*d* is transmitted to the stay 85 via the screws or the like for fixing the belt unit 90 to the stay 85, a force for fixing the belt unit 90 to the stay 85 (fastening forces of the screws 86, in this case) may be weakened.

In this manner, the configuration of the first embodiment is that the belt unit 90 transmits the force received from the cartridge 7 directly to the stay 85 while positioning the cartridge 7 with respect to the belt unit side plates 91 of the belt unit 90. Therefore, the cartridge 7 may be positioned solidly.

Mounting and Demounting of Cartridges

Subsequently, replacement of the cartridge 7 will be described. First of all, in a state in which the cartridge 7 are mounted on the main body of the apparatus 100*a*, the cartridge 7 is at a position illustrated in FIG. 8. At this time, the tray is at a position for determining the position of the cartridge 7 in the main body of the apparatus 100*a*.

Figure 1:
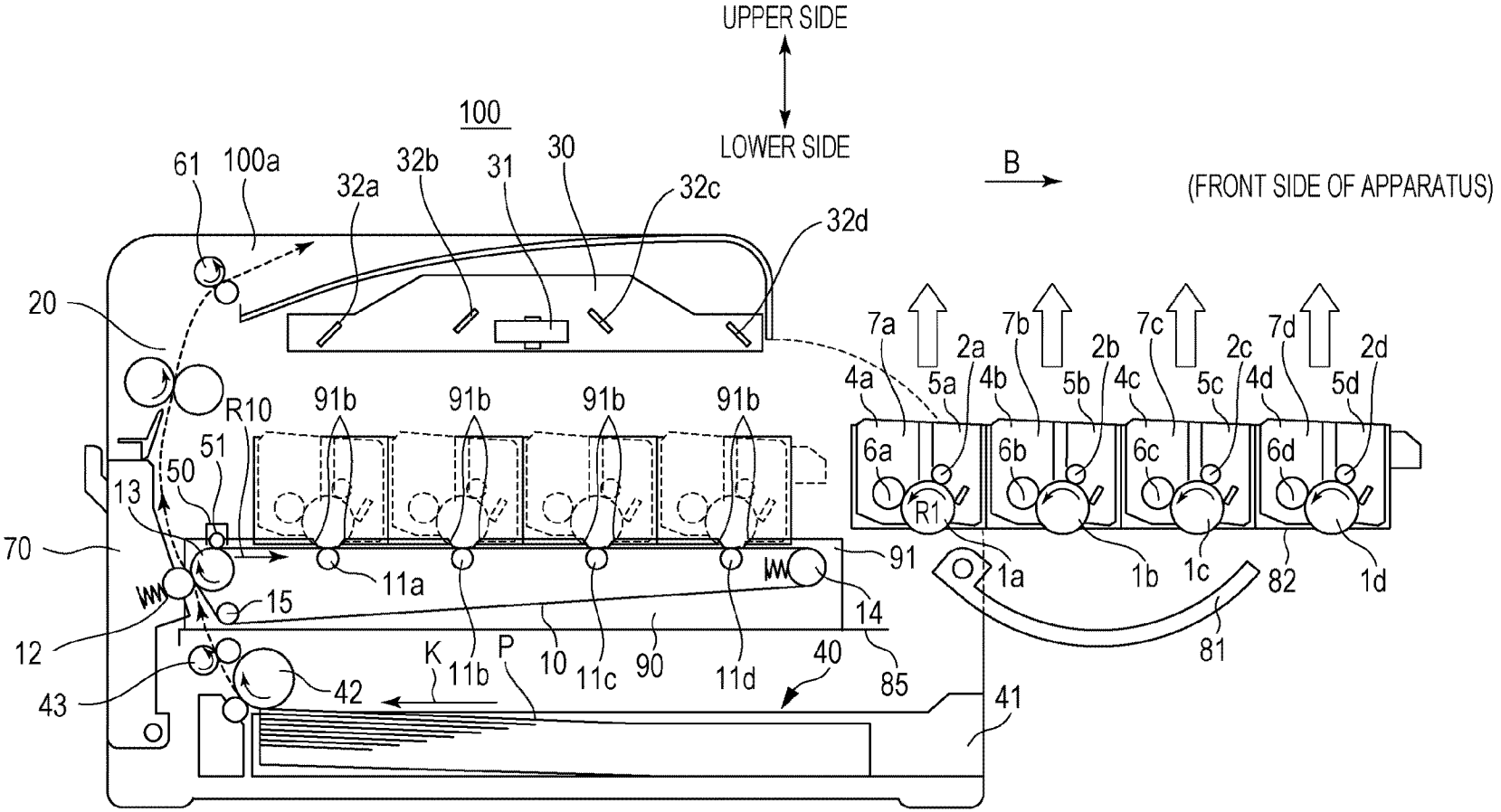
FIG. 1 is a schematic cross-sectional view of an image forming apparatus at the time of replacement of cartridges.

FIG. 1 is a schematic cross-sectional view of the image forming apparatus 100 at the time of replacement of the cartridge 7. A door 81, which corresponds to an opening and closing member configured to open the interior of the main body of the apparatus 100*a* is provided on the front surface of the image forming apparatus 100. When the door 81 is opened, the cartridge tray 82 is moved upward of the main body by a tray hoisting member, not illustrated, which is interlocked with the cartridge tray 82. Accordingly, the cartridges 7*a* to 7*d* are supported by the door 81 and are moved upward of the main body, and hence are retracted from the positioning portions 91*b* of the belt unit side plates 91.

Then, the cartridge tray 82 is drawn out to the front side (direction B) of the main body of the apparatus 100 and is moved to a second position. Therefore, the cartridges 7*a* to 7*d* are moved forward from the inside of the main body of the apparatus 100*a* and are drawn out to the outside of the main body of the apparatus 100*a*. At this time, the cartridge tray 82 is at the second position where the cartridges 7*a* to 7*d* can be demounted substantially upward from the cartridge tray 82. In this manner, the cartridges 7*a* to 7*d* are allowed to be demounted or mounted with respect to the main body of the apparatus 100*a* in a state in which the cartridge tray 82 is drawn out from the inside of the main body of the apparatus 100*a* (second position).

When mounting the cartridges 7*a* to 7*d* on the main body of the apparatus 100*a*, the cartridges 7*a* to 7*d* are placed (mounted) on the cartridge tray 82, and the cartridge tray 82 is inserted into the main body of the apparatus 100*a* in the state in which the cartridge tray 82 is drawn out from the main body of the apparatus 100*a*. Then, by closing the door 81, the tray hoisting member, not illustrated, moves the cartridge tray 82 downward of the main body. Accordingly, the cartridges 7*a* to 7*d* are also moved downward of the main body, and abut against the positioning portions 91*b* of the belt unit side plates 91, whereby the positions are determined. With the procedure described above, mounting of the cartridges 7*a* to 7*d* to the image forming apparatus 100 is completed.

Mounting and Demounting of Belt Unit

Figure 2:
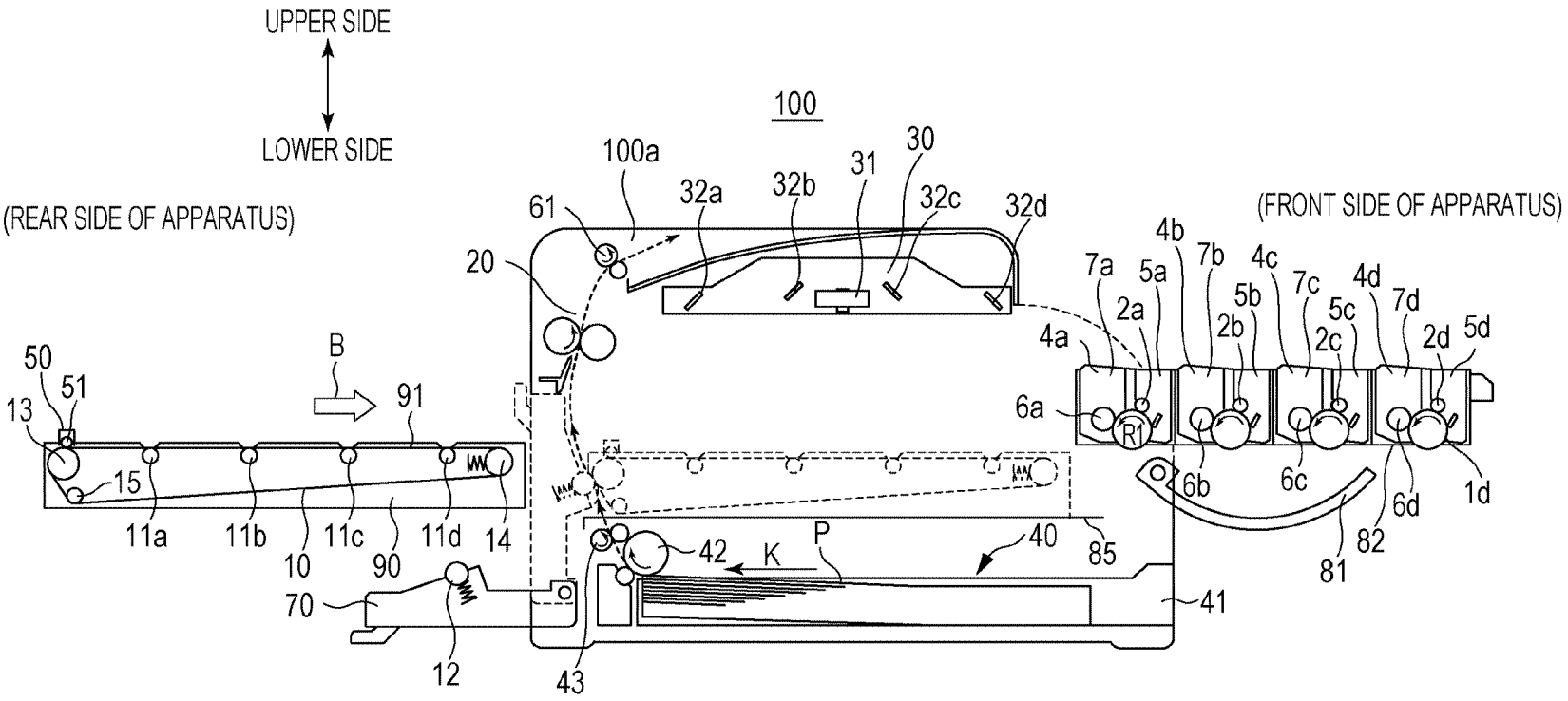
FIG. 2 is a schematic cross-sectional view of the image forming apparatus at the time of replacement of a belt unit.

Subsequently, demounting of the belt unit 90 provided with the intermediate transfer belt 10 from the main body of the apparatus 100*a* will be described. FIG. 2 is a schematic cross-sectional view of the image forming apparatus 100 at the time of replacement of the belt unit 90. A back door 70 configured to be openable and closable with respect to the main body of the apparatus 100*a* is provided on a back surface (rear side) of the main body of the apparatus 100*a*. The back door 70 holds the secondary transfer roller 12. The belt unit 90 is allowed to be demounted by being pulled out through an opening formed by opening the back door 70 to the rear side (left side in FIG. 2) of the main body of the apparatus 100*a*. The belt unit 90 may be mounted by being inserted in the direction B from the rear side to the front side of the main body of the apparatus 100*a* in a procedure opposite from the mounting procedure.

However, when mounting and demounting the belt unit 90 with respect to the main body of the apparatus 100*a*, it is necessary to open the front door 81 and draw out the cartridge tray 82 on which the cartridges 7*a* to 7*d* are mounted to the front side of the main body of the apparatus 100*a* as illustrated in FIG. 2, or to demount all of the cartridges 7*a* to 7*d* from the cartridge tray 82 in advance in order to avoid an interference with the cartridge tray 82 in order to avoid interference with the belt unit 90.

Comparison with Configuration of Related Art

Figure 7:
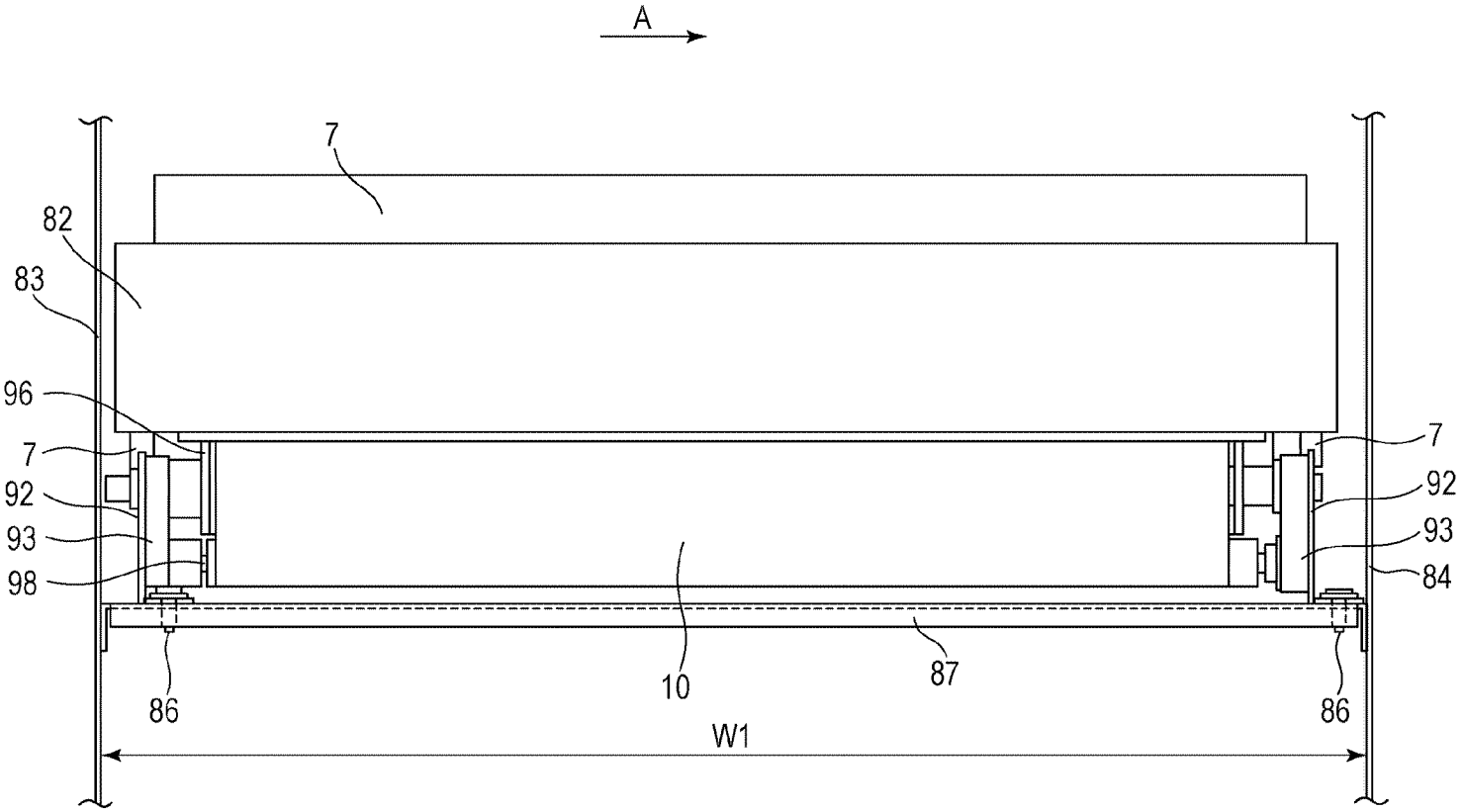
FIG. 7 is a cross-sectional view illustrating a positioning configuration of a cartridge of the related art.

Subsequently, the first embodiment and the related art will be compared. FIG. 7 is a drawing illustrating a positioning configuration of the cartridge 7 of the related art, and illustrating a portion around the cartridge 7 and the intermediate transfer belt 10 of the image forming apparatus having the configuration of the related art viewed from the direction of the array of the photosensitive drums 1*a* to 1*d* like FIG. 4. The main body of the apparatus includes the right side plate 83, the left side plate 84, and a stay 87 fixed between the right side plate 83 and the left side plate 84. A drive roller 96, a tension roller 97, and an auxiliary roller 98 around which the intermediate transfer belt 10 is to be extended are supported by belt unit side plates 93 at both ends in the direction of the axis of the photosensitive drum 1 (direction A), and the belt unit side plates 93 are fixed to the stay 87 with the screws 86 between the right side plate 83 and the left side plate 84.

In the configuration of the related art, positioning plates 92 configured to support the both ends of the cartridge 7 in the direction of the axis of the photosensitive drum (direction A) and determine the position of the cartridge 7 are arranged between the right side plate 83 and the left side plate 84 and on the outside of the belt unit side plate 93 in the direction of the axes of the photosensitive drums (direction A). The positioning plates 92 are positioning members fixed to the stay 87 with the screws 86 and being specific for determining the position of the cartridge 7.

In this manner, in the configuration of the related art, since the positioning plates 92 are provided on the outside of the belt unit side plates 93 in the direction of the axes of the photosensitive drums (direction A), a width W1 between the right side plate 83 and the left side plate 84 needs to be wider correspondingly. In other words, when comparing with a width W2 between the right side plate 83 and the left side plate 84 of the first embodiment illustrated in FIG. 4, a relationship W1>W2 is satisfied, so that the width between the two side plates of the main body in the direction of the axes of the photosensitive drums (the direction A) may be reduced, and hence reduction in size of the apparatus is achieved more in the first embodiment.

In the configuration of the related art, the cost of two of the positioning plates 92 themselves and a process for mounting the positioning plates 92 on the stay 87 are required. However, according to the first embodiment described above, what is required is just to mount the belt unit 90, and the cost of the positioning plates 92 themselves is not required, and the mounting process at the time of manufacture may also be omitted.

As described thus far, according to the first embodiment, cost reduction of the apparatus is achieved while reducing the size of the apparatus in the direction of the axes of the photosensitive drums, and the manufacturing process may be simplified in comparison with a configuration in which specific positioning members are provided by providing the belt unit with cartridge positioning portions.

Second Embodiment

Subsequently, a second embodiment will be described. In the second embodiment, a method of fixing the belt unit 90 to the main body of the apparatus is different from that of the first embodiment. Since other configurations are the same as those of the first embodiment, the same configurations are denoted by the same reference numerals, and descriptions thereof are omitted.

In the second embodiment, a configuration in which part of the image forming apparatus as configured to be a mountable and demountable unit which allows mounting and demounting with respect to the main body of the apparatus in order to facilitate maintenance and component replacement is fixed to the main body of the apparatus will be described.

As a configuration of fixing the mountable and demountable unit to the main body of the apparatus of the related art, a configuration in which a locking member provided on the mountable and demountable unit is pivoted in a direction intersecting a direction of mounting of the mountable and demountable unit to achieve engagement or disengagement with respect to the main body of the apparatus is disclosed in Japanese Patent Laid-Open No. 2007-199613. However, in the configuration disclosed in Japanese Patent Laid-Open No. 2007-199613, the locking member is only urged downward in the perpendicular direction under its own weight and is not fixed. Therefore, in a case where a significant impact or a vibration is applied to the mountable and demountable unit, the locking member is moved to disengage the main body of the apparatus, so that the fixation of the mountable and demountable unit may also be released.

In the second embodiment, a configuration in which the belt unit 90 which corresponds to the mountable and demountable unit is fixed solidly to the main body of the apparatus 100 will be described.

Belt Unit

Figure 10:
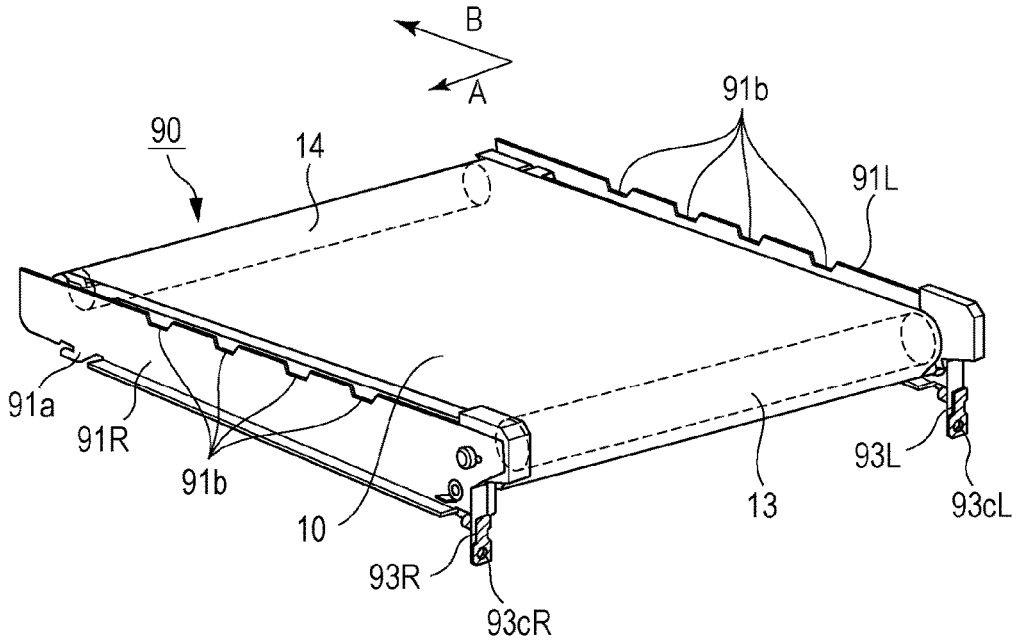
FIG. 10 is a perspective view of the belt unit.

Subsequently, the belt unit 90 provided with the intermediate transfer belt 10 will be described. FIG. 10 is a perspective view of the belt unit 90. The belt unit 90 includes the pair of belt unit side plates (frame side plates) 91 (91L and 91R) provided as the frame of the belt unit 90 at the both ends of the intermediate transfer belt 10 with respect to the direction of the axis of the photosensitive drum 1. The two belt unit side plates 91 rotatably support the drive roller 13, the tension roller 14, and the auxiliary roller 15. The two belt unit side plates 91 the support primary transfer rollers 11*a* to 11*d* via the bearings, not illustrated. The axes of rotation of the drive roller 13, the tension roller 14, and the auxiliary roller 15 are parallel to the direction of the axis of the photosensitive drum 1. The belt unit 90 mounted on the main body of the apparatus 100*a* determines the positions of the photosensitive drums 1*a* to 1*d* of the cartridges 7*a* to 7*d* in the main body of the apparatus 100*a*. Therefore, the belt unit side plates 91L and 91R each include the positioning portions 91*b* against which the bearings of the photosensitive drums 1*a* to 1*d* of the cartridges 7*a* to 7*d* moved downward in the perpendicular direction abut. The positioning portions 91*b* have a plurality of grooves having a V-shape provided corresponding to the respective cartridges 7*a* to 7*d*, and determine the positions of the respective photosensitive drums 1*a* to 1*d* in the direction of the array of the photosensitive drums 1*a* to 1*d* (direction B) and the perpendicular direction. A portion of the belt unit 90 on the downstream side in the direction B is configured to be capable of supporting locking member 93L and 93R, described later.

Figure 13:
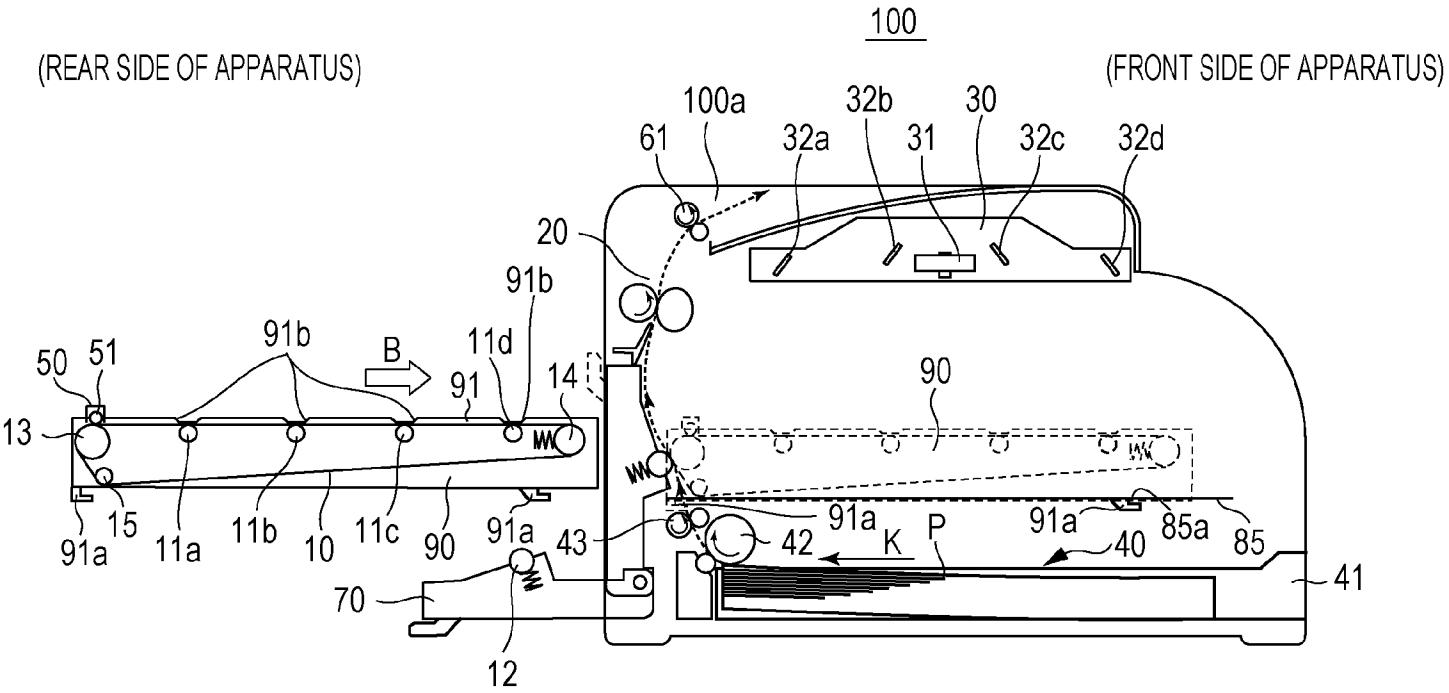
FIG. 13 is a schematic cross-sectional view illustrating a state in which the belt unit is demounted from the image forming main body of the apparatus.

FIG. 13 is a schematic cross-sectional view illustrating a state in which the belt unit 90 is removed from the main body of the apparatus 100*a*. In this manner, the belt unit 90 is the demountable and mountable unit configured to be mountable and demountable with respect to the main body of the apparatus 100*a*. When mounting the belt unit 90 on the main body of the apparatus 100*a*, the belt unit 90 may be inserted into the main body of the apparatus 100*a* in the direction B parallel to the photosensitive drums 1*a* to 1*d* (see FIG. 10) from the rear side to the front side of the main body of the apparatus 100*a* and may be fixed thereto with a locking mechanism, described later. Demounting of the belt unit 90 is achieved by releasing the fixation with the locking mechanism described later, and drawing the belt unit 90 out in a direction from the front side to the rear side of the apparatus (a direction opposite to the direction B).

The two belt unit side plates 91L and 91R are each provided with the positioning portions 91*a* on the upstream side and the downstream side with respect to the direction B. Two of the positioning portions 91*a* on the upstream side in the direction B out of four of the positioning portions 91*a* in total provided on the belt unit side plates 91L and 91R are inserted into two of the positioning holes 85*a* provided on the stay 85 and restricted in position in the direction A parallel to the axis of rotation of the photosensitive drum 1 by the edge portions of the positioning holes 85*a*, whereby the position of the belt unit 90 in the direction of the direction A is determined. The two positioning portions 91*a* on the downstream side in the direction B provided on the belt unit side plates 91L and 91R comes into abutment with an abutting portion 85*d* provided on the stay 85 described later (see FIG. 12A) and restricted in position in the direction B, whereby the position of the belt unit 90 in the direction of the direction A is determined.

Configuration of Locking Mechanism

Figure 9:
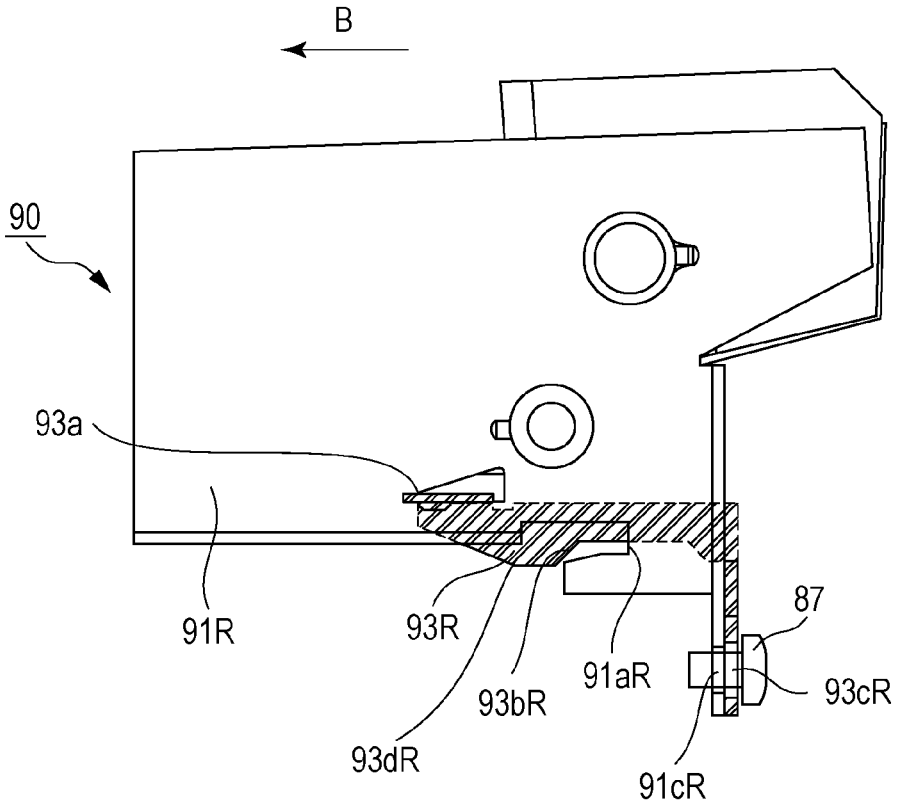
FIG. 9 is a drawing illustrating the belt unit and a locking member.

Subsequently, a locking mechanism of the belt unit 90 will be described. FIG. 9 is a drawing illustrating the belt unit 90 and a locking member 93, which corresponds to a locking member configured to lock (fix) the belt unit 90 included in the locking mechanism. In the description of the second embodiment given below will be described with a configuration of the belt unit side plate 91R side as a representative. However, the belt unit side plate 91L side has the same configuration.

The belt unit side plate 91R is provided with a positioning portion 91*a*R described above and a tightening portion (hole) 91*c*R to be fastened to the stay 85 at an end on the downstream side in the direction B, and rotatably supports the locking member 93R. The locking member 93R is provided with a holding portion 93*a*R, a fixing portion 93*b*R, a tightening portion 93*c*R, and a wedge portion 93*d*R. The holding portion 93*a*R corresponds to a second pressing portion, and is a contact portion with respect to the belt unit side plate 91R to which the locking member 93R is in contact when rotating. The fixing portion 93*b*R corresponds to a first pressing portion and is a portion where the locking member 93R abuts against the stay 85 when the belt unit 90 is fixed to the stay 85. The wedge portion 93*d*R is provided between the holding portion 93*a*R and the fixing portion 93*b*R, and is a portion to be inserted between the belt unit side plate 91R and the stay 85. The tightening portion (hole) 93*c*R is a portion which is overlapped with the tightening portion (hole) 91*c*R of the belt unit side plate 91R and allows insertion of a screw 87, which corresponds to a fastening member, therethrough, so as to be fastened and fixed to the stay 85.

Method of Mounting Belt Unit 90

Figure 11A:
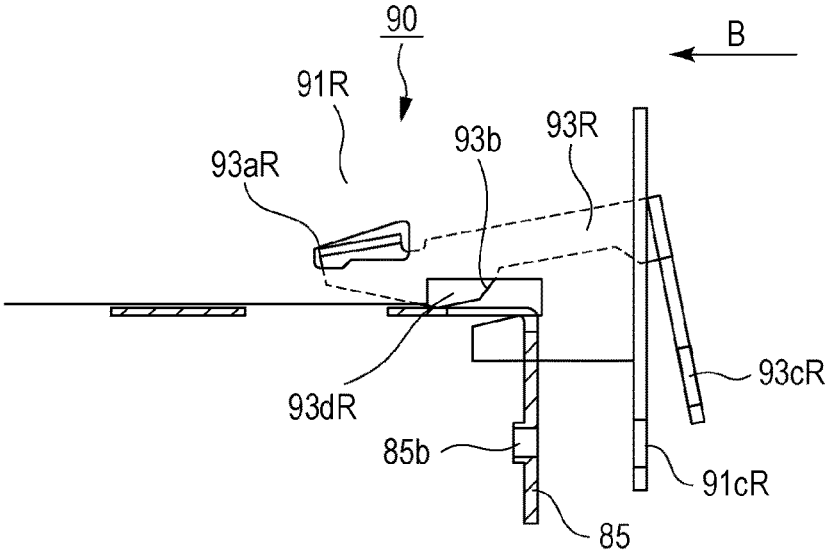
FIG. 11A illustrates a portion in the vicinity of a downstream side of the belt unit in a direction B at the time of mounting the belt unit on a stay when viewed from a direction opposite to a direction A.
Figure 11B:
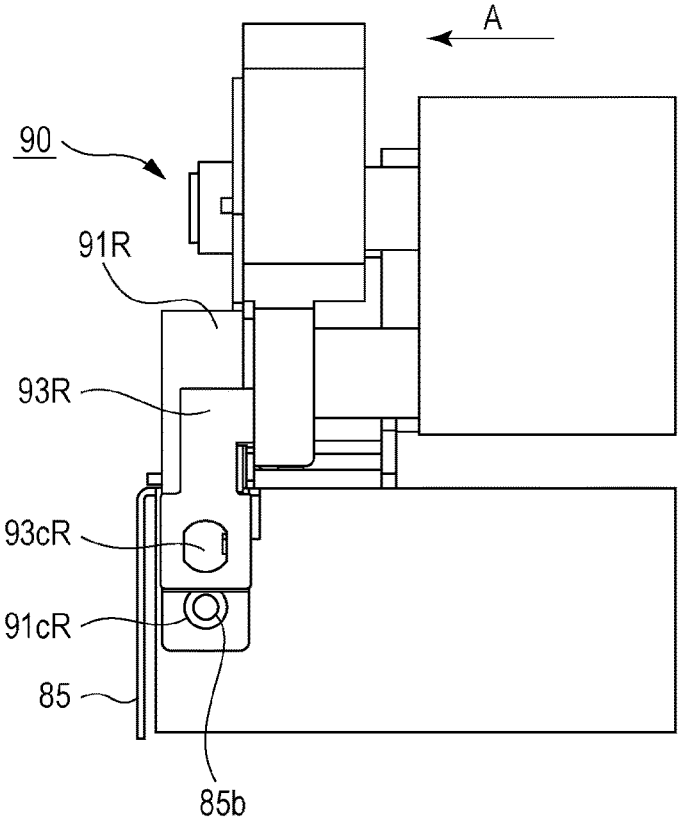
FIG. 11B illustrates the portion in the vicinity of the downstream side of the belt unit in the direction B at the time of mounting the belt unit on the stay when viewed from the direction B.
Figure 12A:
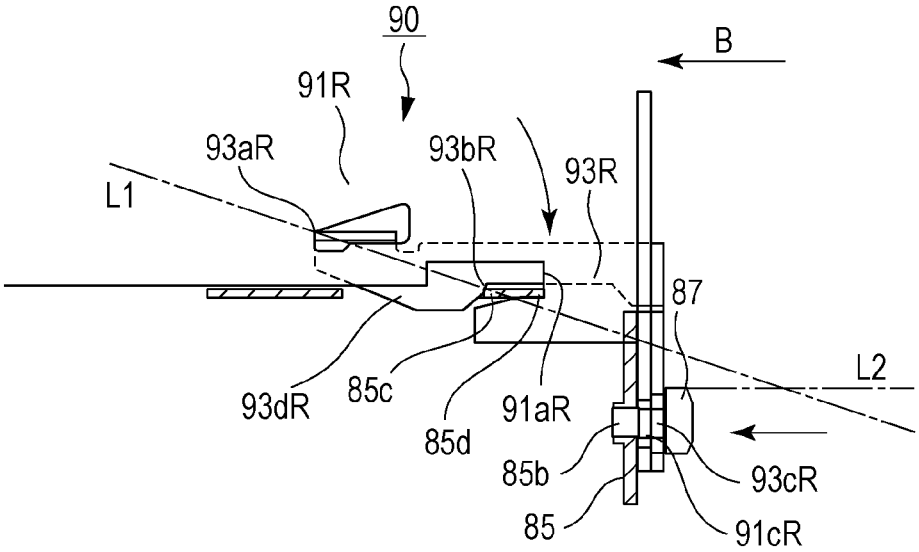
FIG. 12A illustrates the portion in the vicinity of the downstream side of the belt unit mounted on the stay in the direction B when viewed from the direction opposite to the direction A.
Figure 12B:
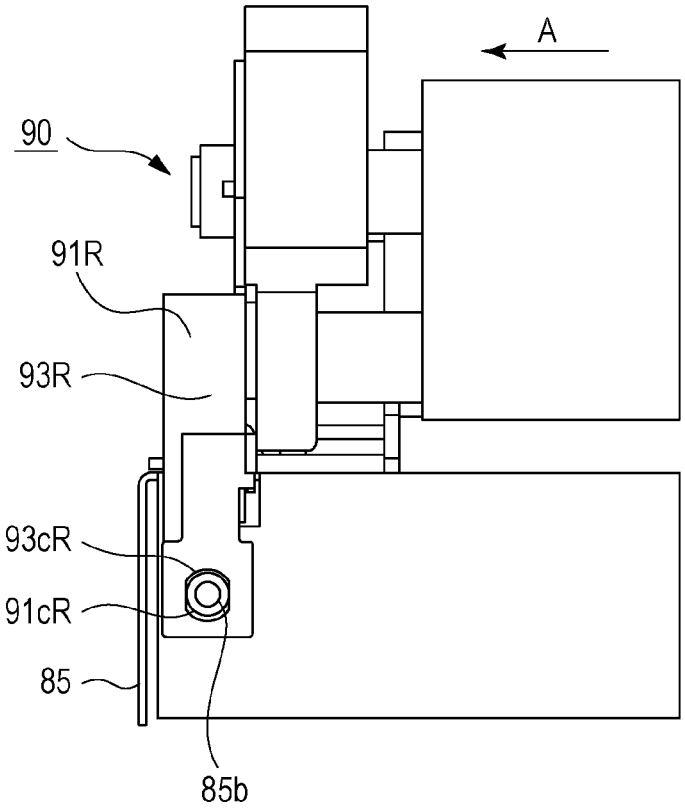
FIG. 12B illustrates the portion in the vicinity of the downstream side of the belt unit mounted on the stay in the direction B when viewed from the direction B.

Subsequently, a method of mounting the belt unit 90 to the stay 85 of the main body of the apparatus 100*a* will be described. FIGS. 11A and 11B are drawings illustrating a portion around a downstream portion of the belt unit 90 in the direction B when moving the belt unit 90 in the direction B and mounting the belt unit 90 on the stay 85. FIG. 11A is a drawing viewed from a direction opposite to the direction A, and FIG. 11B is a drawing viewed from the direction B. FIGS. 12A and 12B are drawings illustrating a portion around the downstream portion of the belt unit 90 in the direction B mounted on the stay 85. FIG. 12A is a drawing viewed from the direction opposite to the direction A, and FIG. 12B is a drawing viewed from the direction B.

In a state illustrated in FIGS. 11A and 11B, the wedge portion 93*d*R of the locking member 93R is on an upper surface of the stay 85 when inserting the belt unit 90 into the main body of the apparatus 100*a* in the direction B and moving the same on the stay 85 in the direction B. In this state, the frame tightening portion (hole) 91*c*R and a tightening portion (hole) 93*c* of the locking member 93R are not aligned, and hence the screw cannot be inserted into the tightening portion (hole) 91*c*R and the tightening portion (hole) 93*c* of the locking member 93R to fasten the belt unit 90 to the stay 85.

Furthermore, when inserting the belt unit 90 in the direction B, as illustrated in FIGS. 12A and 12B, the positioning portion 91*a*R of the belt unit 90 abuts against the abutting portion 85*d* for the belt unit side plate 91R provided on the stay 85 in the direction B. The locking member 93R rotates about a holding portion 93*a* and gets into the hole of the stay 85 under its own weight, the wedge portion 93*d*R is inserted between the belt unit side plate 91R and the stay 85, and a fixing portion 93*b* abuts against an abutting portion 85*c* for the locking member 93R of the stay 85. Accordingly, the frame tightening portion (hole) 91*c*R and the tightening portion (hole) 93*c*R of the locking member 93R are aligned so that the positions thereof match, thereby allowing the screw 87 to be inserted in the direction B and fastened to a fastening portion (hole) 85*b* of the stay 85. Here, a line L1 connecting the holding portion 93*a*R and the fixing portion 93*b*R of the locking member 93R and a line L2 indicating a fastening direction parallel to the direction B intersect each other. Therefore, when fastening with the screw 87, the locking member 93R is pressed by the screw 87 substantially in the direction B and hence the fixing portion 93*b*R rotates about the holding portion 93*a*R in the direction of pressing the abutting portion 85*c* in abutment therewith while pressing the belt unit side plate 91R substantially in the direction B by an end portion of the holding portion 93*a*R. Therefore, the movement of the locking member 93R is restricted by the screw 87, which corresponds to a restricting member, and the belt unit 90 is fixed solidly.

In particular, as in the second embodiment, in the case where the position of the cartridge 7 is determined by the positioning portions 91*b* of the belt unit side plates 91L and 91R, the position of the belt unit 90 itself needs to be determined more solidly. In other words, when replacing the cartridge 7, the cartridge 7 comes into abutment with the belt unit side plates 91L and 91R, and an impact is applied to the belt unit 90. In addition, the developing roller 6 is movable between abutting positions where the developing roller 6 abut against the corresponding photosensitive drum 1 and the retracted position where the developing roller 6 is retracted from the corresponding photosensitive drum 1, and an impact force occurring when the developing roller 6 moves from the retracted position to the abutting position and comes into abutment with the corresponding photosensitive drum 1 (a force substantially in parallel to the direction B) are transmitted to the belt unit side plates 91L and 91R via the photosensitive drum 1. In this manner, since the positioning of the cartridge 7 in the main body of the apparatus 100*a* is achieved by the belt unit 90, the belt unit 90 can resist the impact force from the cartridge 7 by fixing the belt unit 90 solidly to the stay 85 as in the second embodiment.

As described thus far, the positioning of the belt unit 90 in the direction B is performed by the abutting portion 85*d*, and an end portion of the holding portion 93*a* of the locking member 93 presses the belt unit side plates 91 substantially in the direction B by fastening with the screw 87. Accordingly, the belt unit side plates 91 strongly abut against the abutting portion 85*d*, so that the belt unit 90 is fixed solidly to the stay 85. In a case where a force in the direction of demounting the belt unit 90 from the main body of the apparatus 100*a* (a direction opposite to the direction B) is applied to the belt unit 90 as well, the belt unit side plates 91 abuts against the holding portion 93*a* of the locking member 93 and the locking member 93 is also fixed by the fixing portion 93*b* abutting against the abutting portion 85*c*. In this configuration, the belt unit 90 is fixed solidly to the stay 85 without rattling in the direction B, which is the mounting direction, and the direction opposite to the direction B, which is the demounting direction. When the amount of insertion of the belt unit 90 into the main body of the apparatus 100*a* in the direction B at the time of mounting of the belt unit 90 is not sufficient, the tightening portion 93*c* of the locking member 93 does not reach a position which allows fastening with the screw 87, and hence erroneous mounting can be prevented. Since the direction of insertion of the screw (the direction B) is parallel or substantially parallel to the direction of insertion of the belt unit 90 to the main body of the apparatus 100*a*, an insertion or demounting operation of the belt unit 90 and a fastening or unfastening operation of the screw 87 can be performed quickly and continuously, so that good workability is achieved.

The mountable and demountable member fixed by the locking member 93 may be units other than the belt unit which is mountable and demountable with respect to the main body of the apparatus 100*a*. For example, a fixing unit provided with the fixing device 20, a power source unit configured to supply electric power to the main body of the apparatus, or a double-face printing unit provided with a recording material conveying device for double-face printing is also applicable.

Other Embodiments

Although the image forming apparatus using the intermediate transfer belt 10 has been described in the first and second embodiments, an electrostatic transfer belt (ETB) may be employed instead of the intermediate transfer belt 10. In this case, what is essential is that the belt unit 90 includes the electrostatic transfer belt, a plurality of rollers around which the electrostatic transfer belt is extended, and a frame body configured to axially supporting the plurality of rollers, and the frame body includes a positioning portion configured to determine the position of the cartridge 7 in the main body of the apparatus. As long as the frame body of the belt unit 90 is provided with the positioning portion configured to determine the position of the cartridge 7 in the main body of the apparatus, the number of the cartridges 7 may be one. The mounting and demounting of the cartridge 7 may be performed directly by a user or an administrator by accessing the interior of the main body of the apparatus 100*a* without using the cartridge tray 82.

Although the cartridge 7 includes the photosensitive drum 1 and a process device acting thereon in the first and second embodiments. However, a configuration in which the cartridge 7 includes only the developing unit 4, and the photosensitive drum 1 is provided on the cartridge tray 82 is also applicable. In this case, the frame body of the belt unit 90 needs only to be provided with a positioning portion configured to determine the position of the photosensitive drum 1 in the main body of the apparatus or the positioning portion configured to determine the position of the cartridge 7 in the main body of the apparatus.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

What is claimed is:

1. An image forming apparatus comprising:

a main body of the apparatus;

a plurality of cartridges each including a photosensitive member;

a belt unit detachably mounted on the main body of the apparatus, the belt unit comprising:

two belt unit side plates;

an endless belt opposing each photosensitive member; and a plurality of rollers configured to tension the belt, each of the plurality of rollers being directly supported by the two belt unit side plates, wherein the two belt unit side plates are provided with a plurality of positioning portions, wherein positions of the plurality of cartridges are determined by abutment of respective frame bodies of the plurality of cartridges against the two belt unit side plates; and a frame body including two main body side plates opposing each other, wherein a movable member configured to be movable while supporting the plurality of cartridges, moves between the two main body side plates, wherein the frame body includes a stay fixed between the two main body side plates, and wherein the two belt unit side plates are fastened to the stay by screws.

2. The image forming apparatus according to claim 1, wherein the plurality of cartridges abut in a downward direction against the plurality of positioning portions of the two belt unit side plates.

3. The image forming apparatus according to claim 2, wherein the positions of the cartridges in a direction of array of the cartridges are determined respectively by abutment of the frame bodies of the cartridges against the positioning portions.

4. The image forming apparatus according to claim 3, wherein the movable member is movable between a first position in which the plurality of cartridges are within the main body of the apparatus and a second position in which the plurality of cartridges are drawn out from the main body of the apparatus.

5. The image forming apparatus according to claim 4, wherein the movable member moves between the first position and the second position by moving at least in a direction of array of the plurality of cartridges.

6. The image forming apparatus according to claim 4, further comprising:

an opening and closing member configured to open with respect to the main body of the apparatus to open the interior of the main body of the apparatus, wherein the movable member is allowed to be drawn out from the main body of the apparatus by opening the opening and closing member.

7. The image forming apparatus according to claim 6, wherein the plurality of cartridges are moved downward to abut against the positioning portions by closing the opening and closing member.

8. The image forming apparatus according to claim 4, further comprising:

a developing roller configured to abut against the photosensitive member, the developing roller is provided in each of the plurality of cartridges, wherein a direction in which the developing roller abuts against the corresponding photosensitive member includes a component of the direction in which the belt unit is brought into abutment with the main body of the apparatus in order to determine the position in the main body of the apparatus.

9. The image forming apparatus according to claim 4, wherein the two belt unit side plates are configured to rotatably support both axial end portions of the plurality of rollers and the two belt unit side plates are members having the same shape.

10. The image forming apparatus according to claim 4, wherein the movable member is provided above the belt unit.

11. The image forming apparatus according to claim 4, wherein the two belt unit side plates axially support a plurality of transfer rollers, each of the transfer rollers is positioned below each of the positioning portions of the belt unit side plates.

12. The image forming apparatus according to claim 4, wherein each of the plurality of cartridges comprises:

a developing roller configured to be movable from abutment against the photosensitive member to a retracted position; and a bearing portion provided on the frame body of the cartridge for the photosensitive member;

wherein impact forces occurring when the developing roller abuts against the photosensitive member is transmitted from the photosensitive member to the belt unit side plates via the bearing portion of each of the cartridges.

13. The image forming apparatus according to claim 4, wherein the belt unit is configured such that prior to detaching the belt unit from the main body, the movable member is moved to the second position.

14. The image forming apparatus according to claim 1, wherein the plurality of positioning portions of the belt unit have a plurality of grooves having a V-shape.

* * * * *